US011369978B2

(12) United States Patent
Inoue et al.

(10) Patent No.: US 11,369,978 B2
(45) Date of Patent: Jun. 28, 2022

(54) INJECTION HEAD FOR LIQUID FIRE EXTINGUISHING AGENT

(71) Applicant: Koatsu Co., Ltd., Hyogo (JP)

(72) Inventors: Yasufumi Inoue, Hyogo (JP); Masahiro Yabushita, Hyogo (JP); Mitsunori Kamo, Hyogo (JP); Keiichiro Watanabe, Hyogo (JP)

(73) Assignee: KOATSU CO., LTD., Hyogo (JP)

( * ) Notice: Subject to any disclaimer, the term of this patent is extended or adjusted under 35 U.S.C. 154(b) by 90 days.

(21) Appl. No.: 17/251,540

(22) PCT Filed: Sep. 30, 2019

(86) PCT No.: PCT/JP2019/038588
§ 371 (c)(1),
(2) Date: Dec. 11, 2020

(87) PCT Pub. No.: WO2020/071329
PCT Pub. Date: Apr. 9, 2020

(65) Prior Publication Data

US 2021/0252530 A1 Aug. 19, 2021

(30) Foreign Application Priority Data

Oct. 2, 2018 (JP) ..... JP2018-187665

(51) Int. Cl.

| | |
|---|---|
| ***B05B 1/34*** | (2006.01) |
| ***B05B 1/00*** | (2006.01) |
| ***A62C 35/68*** | (2006.01) |
| ***B05B 1/14*** | (2006.01) |

(Continued)

(52) U.S. Cl.
CPC ..... *B05B 1/34* (2013.01); *A62C 31/02* (2013.01); *A62C 35/68* (2013.01); *B05B 1/002* (2018.08); *B05B 1/14* (2013.01); *B05B 15/40* (2018.02)

(58) Field of Classification Search
CPC ..... A62C 31/02; A62C 35/68; B05B 1/24; B05B 1/14; B05B 15/40; B05B 1/002
USPC .... 169/11, 37; 239/451, 456, 505, 513–515, 239/518, 520, 521, 524, 553.3, 575, 590.3
See application file for complete search history.

(56) References Cited

U.S. PATENT DOCUMENTS 3,022,014 A * 2/1962 Young ..... B05B 1/185 239/518
5,404,957 A * 4/1995 McCormack ..... A62C 31/12 239/590.3

(Continued)

*Primary Examiner* — Steven J Ganey
(74) *Attorney, Agent, or Firm* — Wenderoth, Lind & Ponack, L.L.P.

(57) ABSTRACT

An injection head for liquid fire extinguishing agent that has an injection head including an injection head body connecting with a pipe providing the liquid fire extinguishing agent, an orifice plate arranged in the injection head body and formed with an orifice through which flowing the liquid fire extinguishing agent and, a porous member having a block shape arranged in an exiting part of the orifice and, a baffle plate arranged contacting with an end surface of the porous member opposite side of the exiting part of the orifice; and the baffle plate covers at least a projected area of a circumscribed circle of the orifice of the end surface of the porous member and, the liquid fire extinguishing agent is released via a gap formed between the injection head body and the baffle plate.

9 Claims, 19 Drawing Sheets

(51) Int. Cl.
*A62C 31/02* (2006.01)
*B05B 15/40* (2018.01)

(56) References Cited

U.S. PATENT DOCUMENTS

| | | | | |
|---|---|---|---|---|
| 2011/0259617 | A1* | 10/2011 | Lelic | A62C 99/0072 169/37 |
| 2012/0205128 | A1* | 8/2012 | Goto | A62C 31/02 169/11 |
| 2013/0292140 | A1* | 11/2013 | Inoue | A62C 31/02 169/11 |
| 2014/0069663 | A1* | 3/2014 | Yabushita | A62C 31/02 169/37 |

* cited by examiner

[Fig. 2]
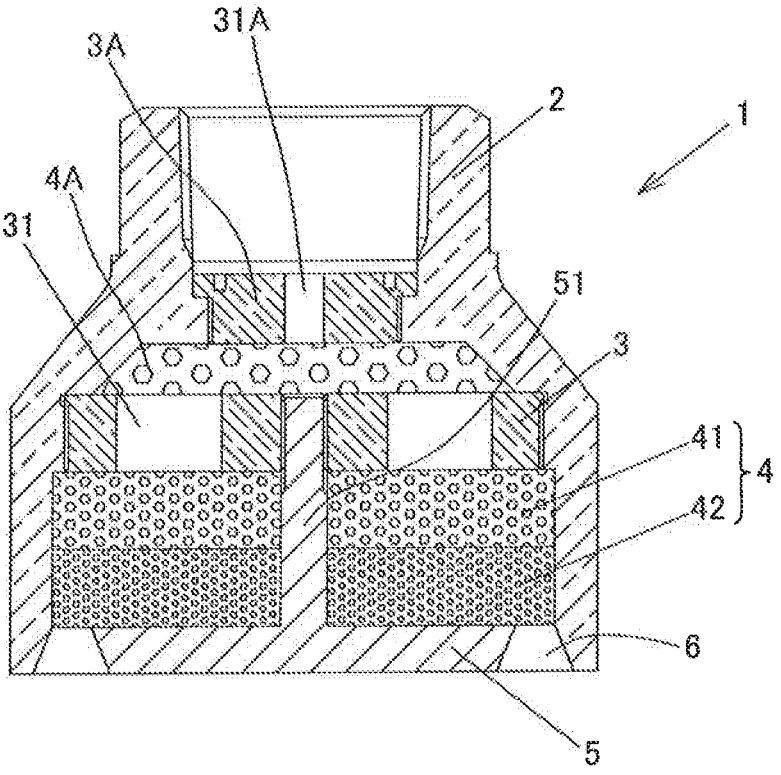

[Fig. 4]
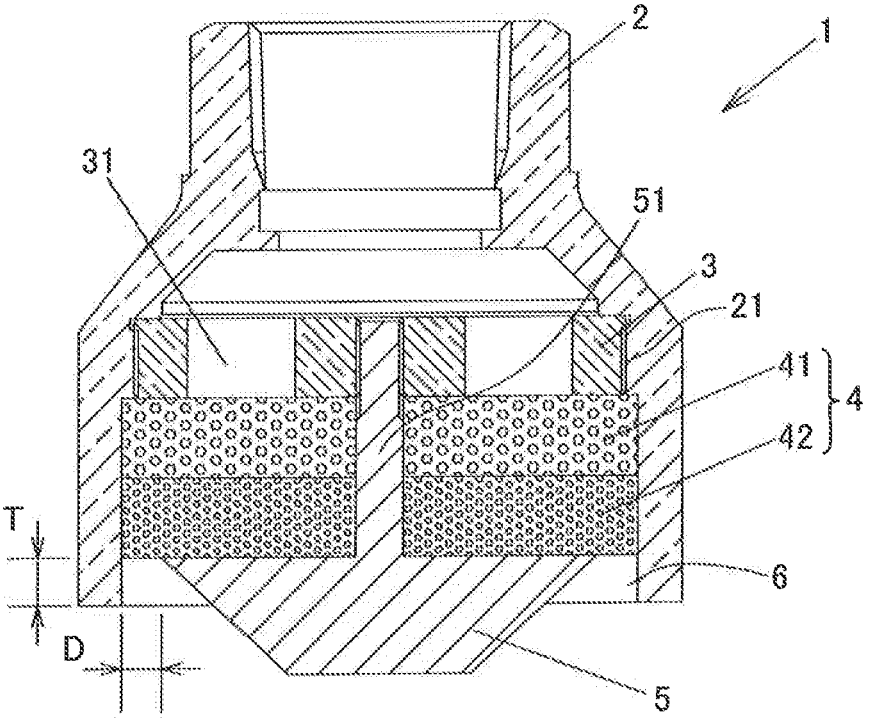

[Fig. 7]
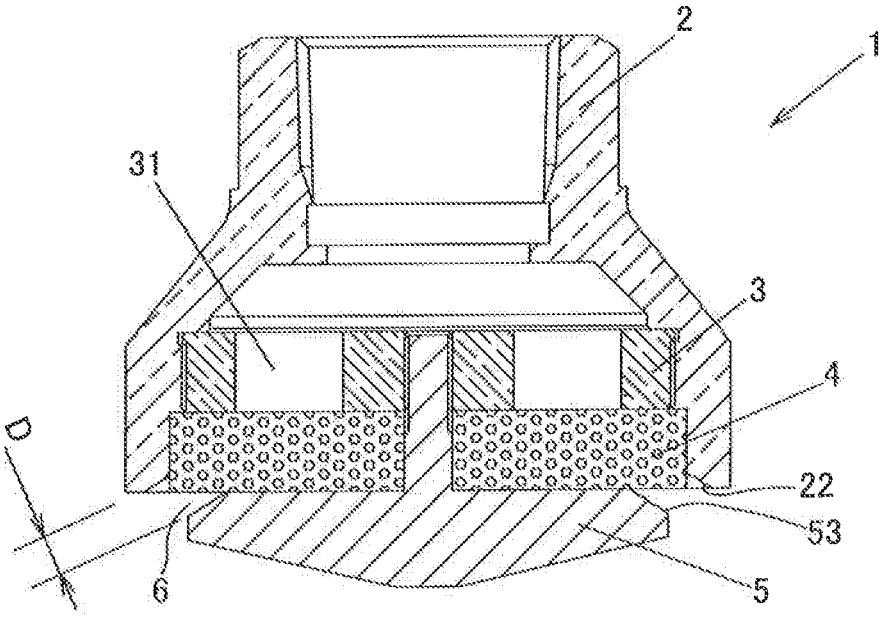

[Fig. 8]
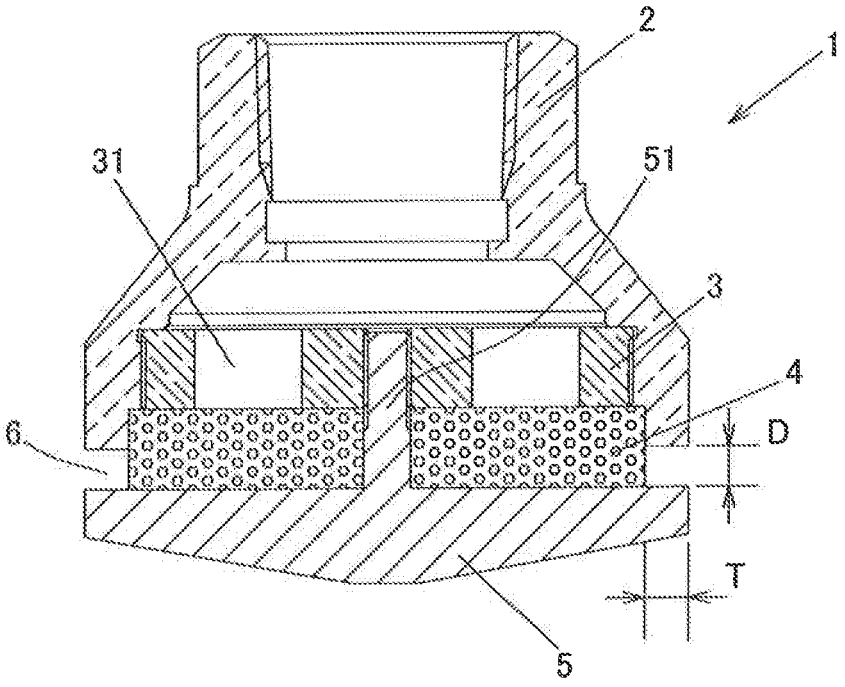

[Fig. 9]
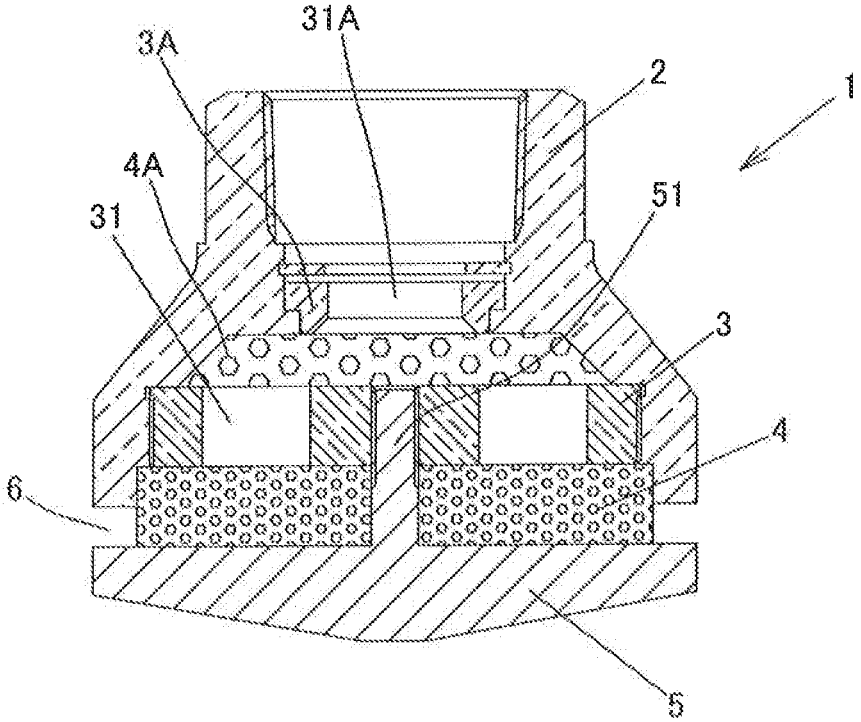

[Fig. 11]
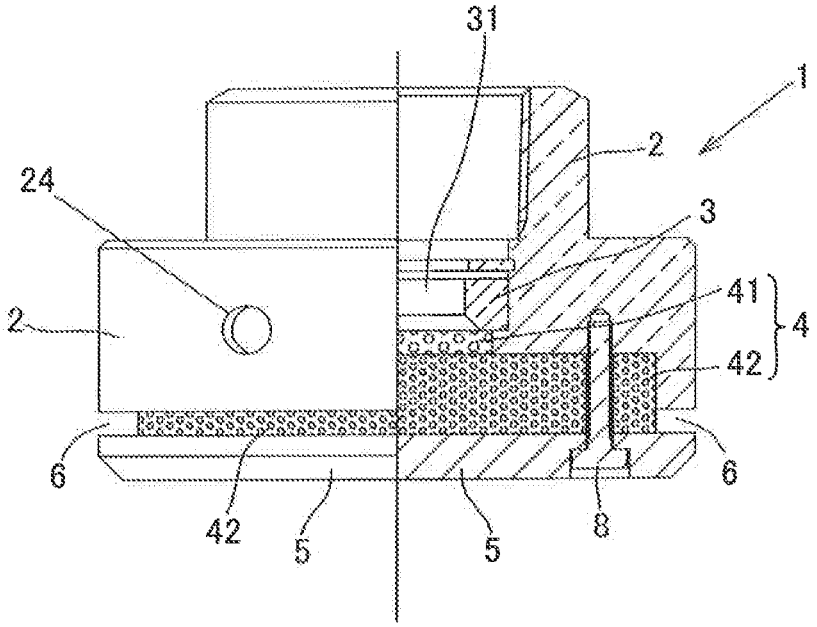

Fig. 13-1(a)
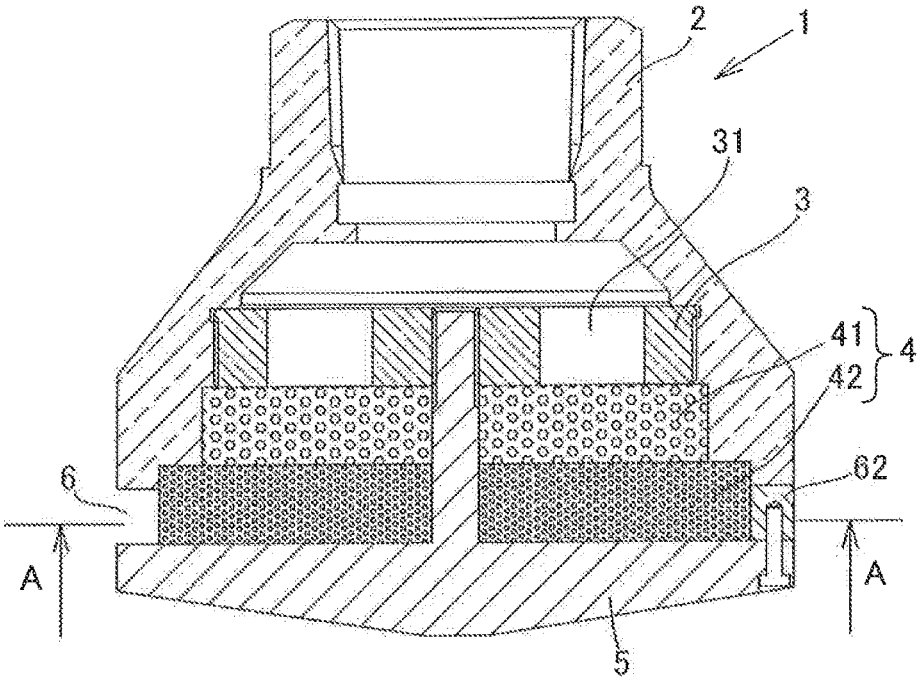
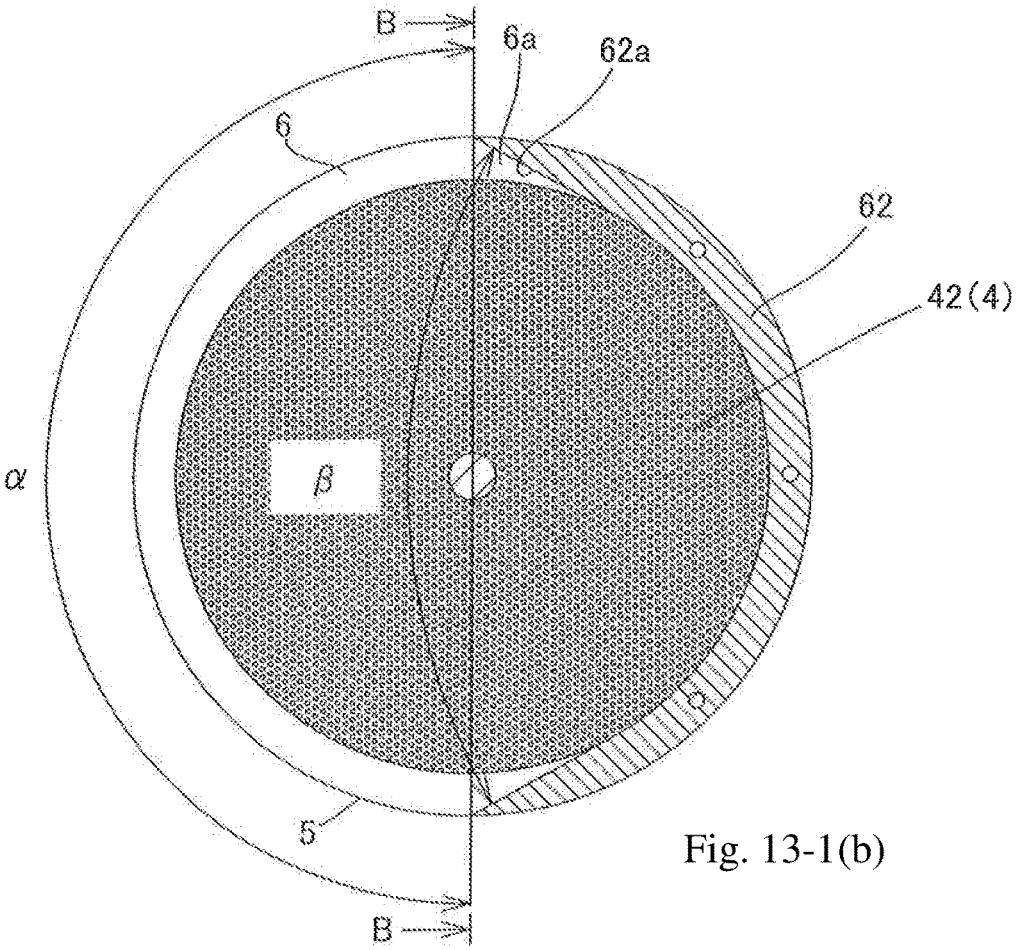
Fig. 13-1(b)

[Fig. 14]
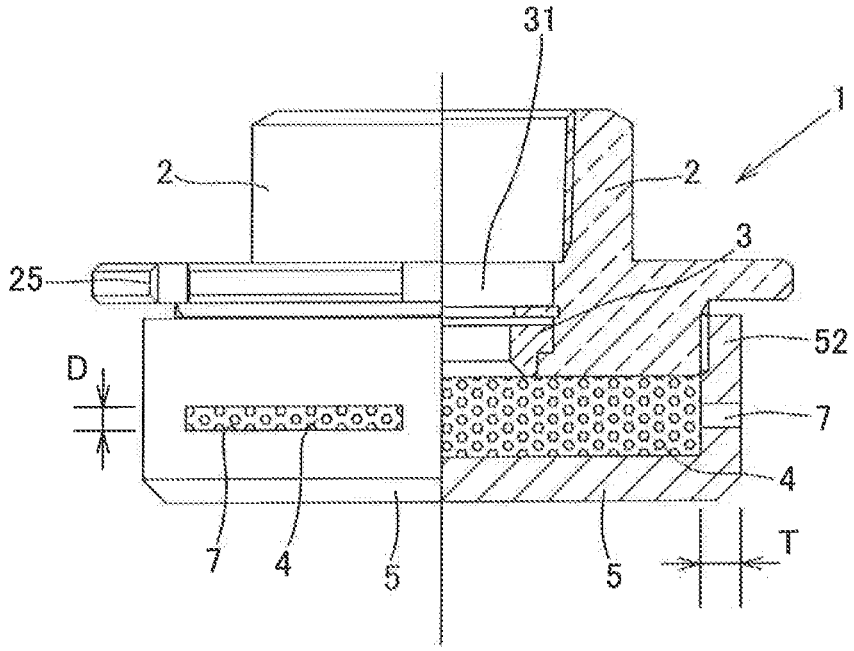

[Fig. 15]
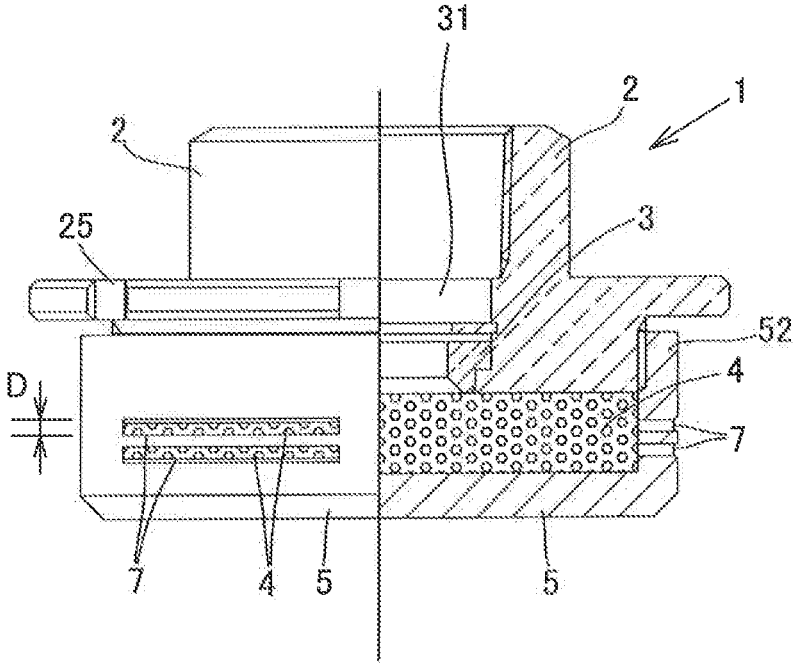

[Fig. 16]
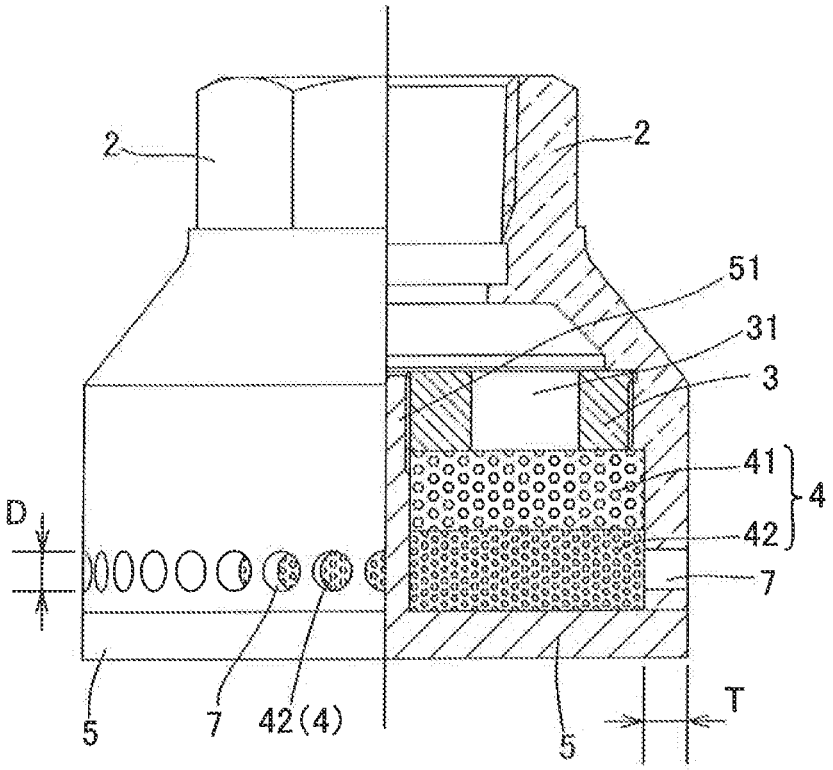

INJECTION HEAD FOR LIQUID FIRE EXTINGUISHING AGENT

TECHNICAL FIELD

The present invention is related to an injection head for liquid fire extinguishing agent having a high boiling point such as halide.

BACKGROUND ART

In a fire extinguishing equipment, as a fire extinguishing agent, when use a liquid fire extinguishing agent having a high boiling point such as halide, for example dodecafluoro-2-methylpentan-3-one ($CF_3CF_2C(O)CF(CF_3)_2$ having a boiling point of 49.2° C., NFPA/ISO registration name "FK-5-1-12"), an injection head spraying mist-like the liquid fire extinguishing agent is used for releasing the liquid fire extinguishing agent to a fire extinguishing area.

However, in the injection head spraying mist-like the liquid fire extinguishing agent, there were problems that diffusion characteristics and vaporization characteristics of the liquid fire extinguishing agent, especially diffusion characteristics in a radial axis direction, were insufficient, a fire extinguishing scope that can be covered by one injection head was small and, in addition high-level noise was generated when the liquid fire extinguishing agent was released from the injection head.

SUMMARY OF INVENTION

Problems to be Solved by the Invention

The present invention is devised in the light of the problems of the injection heads, installed to the fire extinguishing equipments using said liquid fire extinguishing agent, for releasing the liquid fire extinguishing agent into a fire extinguishing area. The object of the present invention is to provide an injection head for liquid fire extinguishing agent that has good characteristics of diffusion and vaporization of a liquid fire extinguishing agent, can enlarge a fire extinguishing scope covering by one injection head and, as well as can enhance reduction efficiency of noise.

Means for Solving the Problems

To achieve the object, an injection head for liquid fire extinguishing agent of the present invention, in a fire extinguishing equipment using a liquid fire extinguishing agent, arranged for releasing the liquid fire extinguishing agent to a fire extinguishing area, wherein the injection head comprising of: an injection head body for connecting with a pipe providing the liquid fire extinguishing agent; an orifice plate arranged in the injection head body and forming with an orifice through which flowing the liquid fire extinguishing agent; a porous member having a block shape arranged in a exiting part of the orifice; and a baffle plate contacting with a end surface of said porous member opposite side of the exiting part of the orifice; wherein said baffle plate covers at least a projected area of a circumscribed circle of the orifice of an end surface of the porous member and, as well as the liquid fire extinguishing agent is released via a gap formed between the injection head body and the baffle plate, and/or, a through hole formed outside of the projected area of the circumscribed circle of the orifice of the injection head body and/or the baffle plate.

In this case, a release form of said liquid fire extinguishing agent can be a cylindrical shape in the same direction as an axial direction of the orifice.

A release form of said liquid fire extinguishing agent has a conical shape having a predetermined angle to an axial direction of an orifice.

Also, a release form of said liquid fire extinguishing agent has a disk shape in a direction orthogonal to an axial direction of the orifice.

Also, a release form of said liquid fire extinguishing agent has a fan shape having a predetermined angle in a direction orthogonal to an axial direction of the orifice.

In this case, a partition wall for making release form of said liquid fire extinguishing agent a fan shape and that forms both ends of the gap formed between the injection head body and the baffle plate is arranged on an inclined surface facing to the opposite side of the gap and, the gap having a wedge shape can be formed between the inclined surface and the porous member.

Also. a width dimension of said gap and/or the through hole is preferably 30 mm or less, more preferably 1 mm to 10 mm, the ratio of an inner diameter to an outer diameter of said gap, and/or, the ratio of a diameter of a small-diameter circle to a diameter of a large-diameter circle which are contacting commonly with a plurality of through holes can be set 0.70 or more.

Effects of Invention

According to the injection head for liquid fire extinguishing agent of the present invention, a liquid fire extinguishing agent provided through the orifice diffuses while flowing inside a porous member having a block shape without short path and, release direction of the liquid fire extinguishing agent is limited in a specific direction by a baffle plate, and hence diffusion characteristics and vaporization characteristics of the liquid fire extinguishing agent are improved, and the liquid fire extinguishing agent can be sprayed and vaporized in a wide scope. As a result, a fire extinguishing scope covered by one injection head can be enlarged.

Also, because a liquid fire extinguishing agent is diffusing by flowing porous member having block shape without shot path and released, a noise generated during releasing liquid fire extinguishing agent can be reduced.

Also, a release form of said liquid fire extinguishing agent has a cylindrical shape in the direction as the same as the axial direction of the orifice, and hence diffusion characteristics in the direction as the same as the axial direction of the orifice of the liquid fire extinguishing agent are improved and, the liquid fire extinguishing agent can be sprayed and vaporized in more wide scope.

Also, a release from of said liquid fire extinguishing agent has a conical shape having a predetermined angle to the axial direction of the orifice, diffusion characteristic in the direction as the same as the axial direction of the orifice of the liquid fire extinguishing agent is improved, further, by providing diffusion characteristic of a direction component orthogonal to the axial direction of the orifice of the liquid fire extinguishing agent, the liquid fire extinguishing agent can be sprayed in wide scope and vaporized.

Also, a release form of said liquid fire extinguishing agent has a disk shape in the direction orthogonal to the axial direction of the orifice, and hence diffusion characteristics in the direction orthogonal to the axial direction of the orifice of the liquid fire extinguishing agent are improved and, the liquid fire extinguishing agent can be sprayed and vaporized in more wide scope.

Also, a release form of said liquid fire extinguishing agent has a fan shape in the direction orthogonal to the axial direction of the orifice, and hence diffusion characteristics in the direction orthogonal to the axial direction of the orifice of the liquid fire extinguishing agent are improved and, the liquid fire extinguishing agent can be sprayed in a specific direction and vaporized.

In this case, a partition wall for making a release form of said liquid fire extinguishing agent a fan shape and that forms both ends of the gap formed between the injection head body and the baffle plate is arranged on an inclined surface facing to the opposite side of the gap and, the gap having a wedge shape is formed between the inclined surface and the porous member, an open area to the atmosphere of the porous member can be increased.

Also, a width dimension of said gap and/or the through hole is preferably 30 mm or less, more preferably 1 mm to 10 mm, the ratio of an inner diameter to an outer diameter of said gap, and/or, the ratio of a diameter of a small-diameter circle to a diameter of a large-diameter circle which are contacting commonly with a plurality of through holes can be set 0.70 or more.

BRIEF DESCRIPTION OF DRAWINGS

FIG. 2 is a front sectional view illustrating a modified embodiment of the first embodiment of an injection head for liquid fire extinguishing agent of the present invention.

FIG. 4 is a front sectional view illustrating a modified embodiment of the first embodiment of the injection head for liquid fire extinguishing agent of the present invention.

FIG. 7 is a sectional view illustrating a second embodiment of an injection head for liquid fire extinguishing agent of the present invention.

FIG. 8 is a sectional view illustrating a third embodiment of an injection head for liquid fire extinguishing agent of the present invention.

FIG. 9 is a front sectional view illustrating a modified embodiment of the third embodiment of the injection head for liquid fire extinguishing agent of the present invention.

FIG. 11 is a front view (a partial sectional view) illustrating a modified embodiment of the third embodiment of the injection head for liquid fire extinguishing agent of the present invention.

FIGS. 12-1(*a*) and 12-1(*b*) are drawings illustrating a modified embodiment of the third embodiment of the injection head for liquid fire extinguishing agent of the present invention, FIG. 12-1(*a*) is a front sectional view and, FIG. 12-1(*b*) is an A-A cross section.

FIGS. 12-2(*a*) and 12-2(*b*) are drawings illustrating a modified embodiment of the third embodiment of the injection head for liquid fire extinguishing agent of the present invention, FIG. 12-2(*a*) is a front sectional view and, FIG. 12-2(*b*) is an A-A cross section.

FIGS. 13-1(*a*) and 13-1(*b*) are drawings illustrating a modified embodiment of the third embodiment of the injection head for liquid fire extinguishing agent of the present invention, FIG. 13-1(*a*) is a front sectional view and, FIG. 13-1(*b*) is an A-A cross section.

FIGS. 13-2(*a*)-13(*e*) are drawings illustrating a modified embodiment of the third embodiment of the injection head for liquid fire extinguishing agent of the present invention, FIG. 13-2(*a*) is a B-B cross section, FIG. 13-2(*b*) is a section view according to the modified embodiment using closing members having different shapes, and FIG. 13-2(*c*) to FIG. 13-2(*e*) are explanatory drawings of closing members having different shapes.

FIG. 14 is a front view (a partial sectional view) illustrating a modified embodiment of the third embodiment of the injection head for liquid fire extinguishing agent of the present invention.

FIG. 15 is a front view (a partial sectional view) illustrating a modified embodiment of the third embodiment of the injection head for liquid fire extinguishing agent of the present invention.

FIG. 16 is a front view (a partial sectional view) illustrating a modified embodiment of the third embodiment of the injection head for liquid fire extinguishing agent of the present invention.

BEST MODE FOR CARRYING OUT THE INVENTION

Figure 1A:
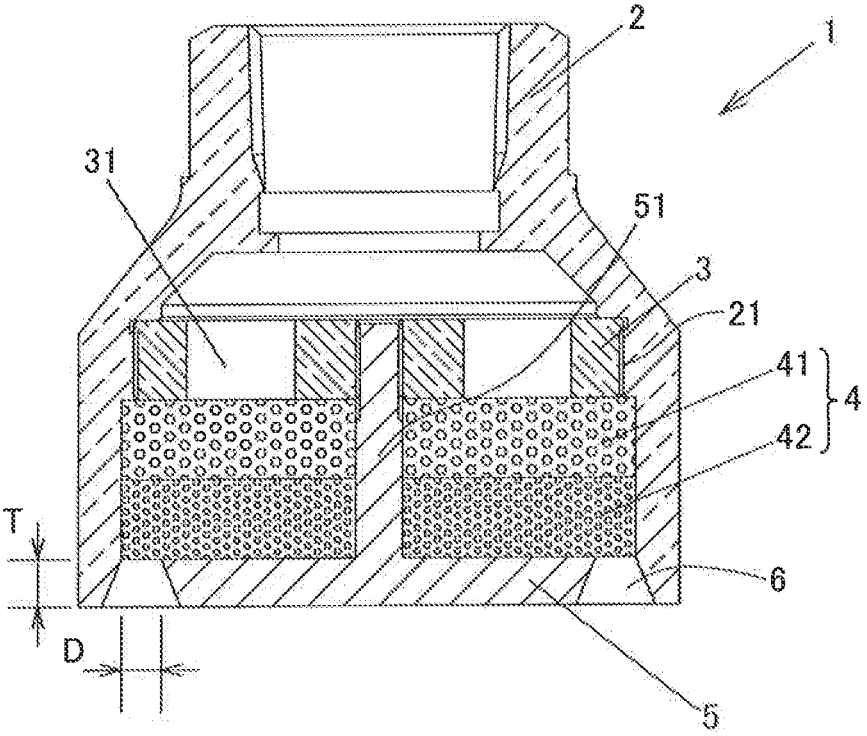
FIGS. 1(*a*) and 1(*b*) are drawings illustrating a first embodiment of an injection head for liquid fire extinguishing agent of the present invention, FIG. 1(*a*) is a front sectional view and, FIG. 1(*b*) is a bottom view.
Figure 1B:
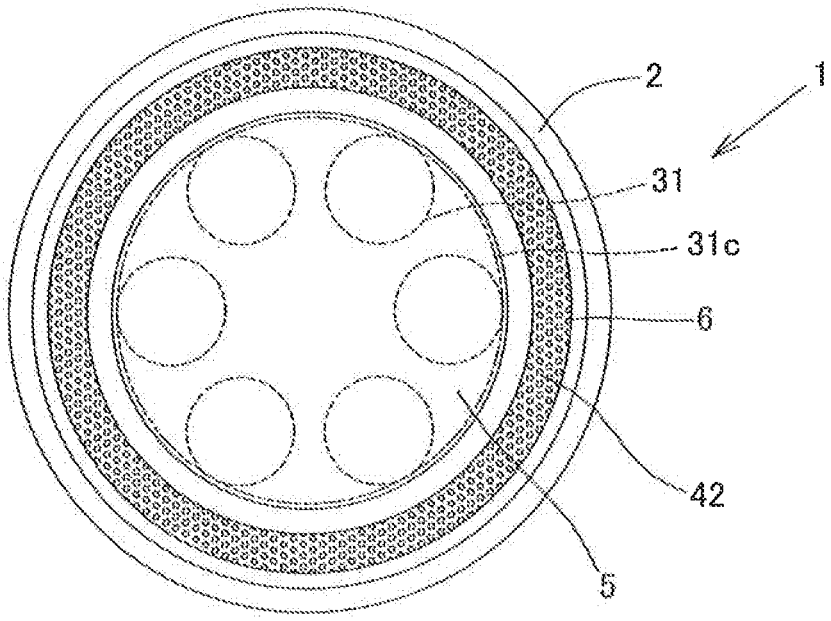

An embodiment of an injection head for liquid fire extinguishing agent of the present invention is described below by reference to the accompanying drawings.

FIG. 1 is showing the first embodiment of the injection head for liquid fire extinguishing agent of the present invention.

This injection head for liquid fire extinguishing agent 1 is, in a fire extinguishing equipment using liquid fire extinguishing agent, arranged for releasing a liquid fire extinguishing agent to a fire extinguishing area; the injection head 1 is comprising of an injection head body 2 connecting with a pipe (not shown) providing the liquid fire extinguishing agent, an orifice plate 3 arranged in the injection head body 2 and formed with an orifice 31 through which flowing the liquid fire extinguishing agent and, a porous member 4 having a block shape arranged in an exiting part of the orifice 31 and, a baffle plate 5 arranged contacting with an end surface of the porous member 4 opposite side of the exiting part of the orifice 31, and the baffle plate 5 covers at least a projected area of a circumscribed circle 31*c* of the orifice 31 of the end surface of the porous member 4 and, the liquid fire extinguishing agent is released via a gap 6 formed between the injection head body 2 and the baffle plate 5.

Here, the injection head 1 is formed in a round shape having rotational symmetry around a central axis.

Also, a female thread (or a male thread) for connecting the pipe is formed in the injection head body 2 for connecting the pipe providing the liquid fire extinguishing agent.

Here, the liquid fire extinguishing agent that this injection head for liquid fire extinguishing agent 1 subjects includes fire extinguishing agents (1)-(3) below.

(1) A fire extinguishing agent preserved in liquid in a storage container in general preservation state, for embodiment halide fire extinguishing agents such as halon 1301.

(2) A fire extinguishing agent, such as HFC-227ea, having a liquid state in a pipe just before an injection head when released from the injection head.

(3) A fire extinguishing agent having a boiling point 0° C. or higher, such as dodecafluoro-2-methylpentan-3-one (CF3 CF2 C(O)CF(CF3)2), boiling point: 49.2° C., NFPA/ISO registration name: "FK-5-1-12").

In this case, the orifice plate 3 has a disk shape that is formed by placing one or more orifices 31 (6 pieces in the present embodiment) in equiangular spacing in the center, the orifice plate 3 is detachable arranged on a step part 21 formed in an interior space of the injection head body 2, for example, via threads formed on peripheral surfaces of the step part 21 and the orifice plate 3. As a result, the orifice plate 3 formed with a plurality of types of orifices 31 can be selected according to the conditions such as installation location.

The porous member 4 having a block shape is composed of an integrated structure, as well as, as the present embodiment, the porous member 4 can be composed of a divided structure, laminated a plurality of porous members 41, 42.

As the porous member 4 having block shape, it can be preferably used materials having high shape retention performance, that is inorganic materials (metal, metal oxide, metal hydroxide etc.) no deformation by a release pressure of the liquid fire extinguishing agent, and can be used more preferably porous metal material (Cermet (Registered tradename), made by Sumitomo Electric Industries) comprising 3 dimensional reticulated structure.

The pore diameter of pores in the porous material 4 composes the whole body with homogeneous material, as well as the whole body can be composed of material that a pore diameter of pores changed gradually smaller in the flowing direction of the liquid fire extinguishing agent, for example, in the present embodiment, it can be composed of material smaller in a pore diameter of pores in a porous member 42 of downstream side of the liquid fire extinguishing agent member than a pore diameter of pores in a porous member 41 of upstream side.

Thus, by making smaller the pore diameter of pores in the porous member 4 along the flow direction of the liquid fire extinguishing agent, the liquid fire extinguishing agent flowing in the porous member having block shape can be uniformly diffused.

Then, in any case of the integrated structure and the divided structure, by set arranging the end face of one side of the porous member 4 in contact with the injection head body 2 (In the present embodiment, the orifice plate 3 is included. The same in another embodiments below), the porous member 4 is arranged on an exiting part of the orifice 31.

Also, the baffle plate 5 is arranged in contact with an end face of another side of the porous member 4, that is an end face of the opposite side of the exiting part of the orifice 31 of the porous member 4.

By the way, in the present embodiment, the orifice plate 3 and the porous member 4 have one-step structure, but like a modified embodiment shown in FIG. 2, they can be 2 step structure (or a multistage structure comprising 3 or more steps) by arranging an orifice plate 3A, formed with an orifice 31A, and a porous member 4A in the upstream sides of the orifice plate 3 and the porous member 4.

As a result, inside the injection head body 2, uniform diffusion characteristics of the liquid fire extinguishing agent can be improved.

Also, in a modified embodiment shown in FIG. 2, the orifice plate 3 A is composed detachably in the injection head body 2 via an opening of a connection side of the injection head body 2 for connecting to the pipe (The orifice plates 3 of embodiments shown in FIG. 6, FIG. 9, FIG. 11, FIG. 14 and FIG. 15 are the same).

As a result, the porous member 4 is assembled to the injection head body 2 and is preserved as stock, and when shipping it, the orifice plate 3A (The orifice plate 3) corresponding to the flow rate of the liquid fire extinguishing agent released from the injection head can be mounted to the injection head body 2 via the opening of the connection side of the injection head body 2 for that connecting to the pipe. Then, as a result, the injection heads of these embodiments that become upsizing comparing to general injection heads are easy to preserve as stock and, while solving problems that are restrictions of storage locations, cost increasing etc., the shipment of the injection head can be speedily performed.

Figure 3A:
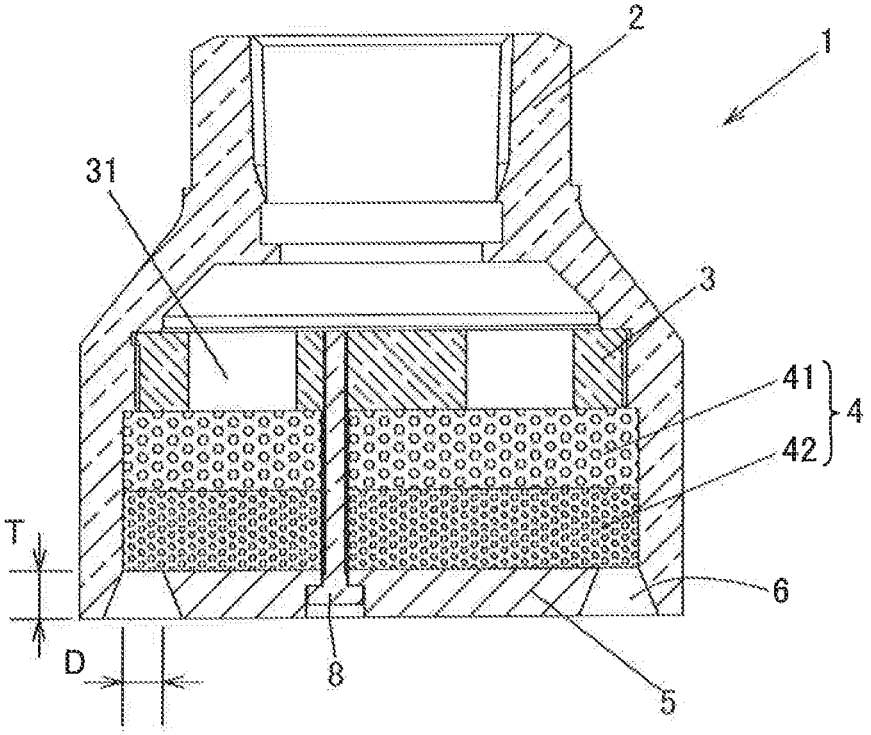
FIGS. 3(*a*) and 3(*b*) are drawings illustrating a modified embodiment of the first embodiment of the injection head for liquid fire extinguishing agent of the present invention, FIG. 3(*a*) is a front sectional view and, FIG. 3(*b*) is a bottom view.
Figure 3B:
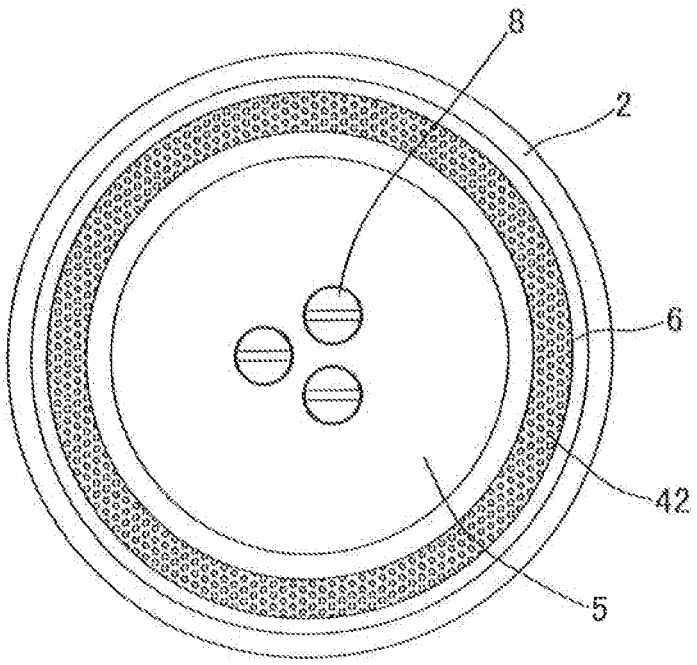

By screwing a thread part 51 (The thread part 51 is formed integrating to the baffle plate 5, and as well as, like a modified embodiment shown in FIG. 3, it can be composed of another members (The thread members 8). Also, when the thread part 51 is composed of the thread member 8, 1 or more thread members 8 can be used) penetrating a central part of the porous member 4 to the orifice plate 3 (or the thread part 51 is composed of a bold and a nut and is fastened to the orifice plate 3), the baffle plate 5 is fixed to the injection head body 2.

Then, by contacting the baffle plate 5 with the end surface of another side of the porous member 4, it covers at least a projected area of a circumscribed circle 31*c* of the end surface of the porous member 4 (In the present embodiment, 6 pieces of the common circumscribed circles 31*c* of the orifice 31), and hence the liquid fire extinguishing agent does not release from this part and, the liquid fire extinguishing agent is released via the gap 6 formed between the injection head body 2 and the baffle plate 5.

In the present embodiment, the gap 6 formed between the injection head body 2 and the baffle plate 5 is composed of slits having torus shape with an outlet side slightly expanded, and hence release form of the liquid fire extinguishing agent can be a cylindrical shape in the same direction as the axial direction of the orifice 31 (The axial direction of the central axis of the injection head body 2).

Here, the width dimension D of the gap 6 comprising slits having torus shapes can be properly set according to the capacity of the injection head for liquid fire extinguishing agent 1 or a liquid fire extinguishing agent that is a subject, but it is set preferably 30 mm or less, more preferably 1 mm to about 10 mm and, is set as being the ratio of a inner diameter to a outer diameter of the gap 6 0.70 or more.

Also, a dimension T in the thickness direction of the gap 6 (The baffle plate 5) comprising of slits having torus shapes can be arranged preferably 30 mm or less, more preferably 1 mm to 10 mm, so as to be able limiting the releasing direction of the liquid fire extinguishing agent in a specific direction.

As a result, the diffusion characteristic in the same direction as the axial direction (An axial direction of the central axis of the injection head body 2) of the orifice 31 of the liquid fire extinguishing agent can be improved.

According to the injection head for liquid fire extinguishing agent 1 of the present invention, the liquid fire extinguishing agent provided through the orifice 31 diffuses while flowing inside the porous member 4 having block shape without short path and, release direction of the liquid fire extinguishing agent is limited in a specific direction by the baffle plate 5, and hence diffusion characteristics and vaporization characteristics of the liquid fire extinguishing agent are improved and, the liquid fire extinguishing agent can be sprayed and vaporized in a wide scope. As a result, the fire extinguishing scope that can cover by one injection head 1 can be enlarged.

Also, because the liquid fire extinguishing agent is diffusing while flowing inside the porous member 4 having block shape without shot path and released, a noise generated during releasing the liquid fire extinguishing agent can be reduced.

By the way, in the first embodiment abovementioned, the gap 6 formed between the injection head body 2 and the baffle plate 5 is composed of slits having torus shapes with slightly expanded outlet side, but a shape of the gap 6, not limited, is composed of slits having torus shapes having a straight outlet side that is without expanded, and hence diffusion characteristics in the direction as the same as the axial direction of the orifice 31 of the liquid fire extinguishing agent (The axial direction of the central axis of the injection head body 2) are improved and, the liquid fire extinguishing agent can be sprayed and vaporized in more wide scope.

Also, like a modified embodiment shown in FIG. 4, making the injection head body 2 side a straight shape and, the baffle plate 5 side is composed of slits having torus shapes that largely expanded than the first embodiment, and hence the diffusion characteristics to the center direction of the liquid fire extinguishing agent releasing in torus shape can be improved.

Figure 5A:
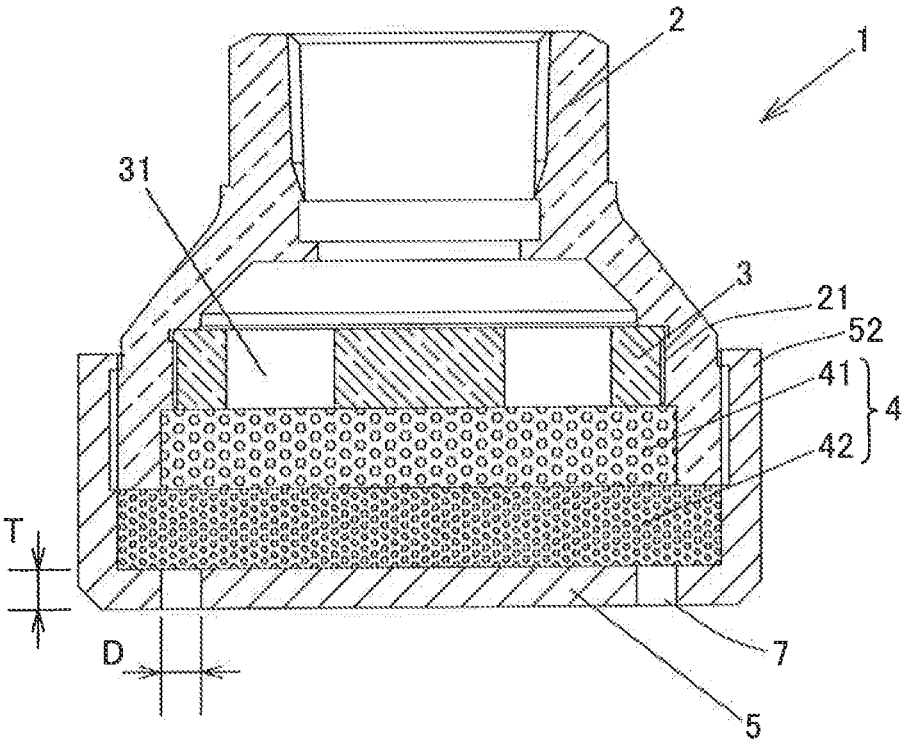
FIGS. 5(*a*) and 5(*b*) are drawings illustrating a modified embodiment of the first embodiment of the injection head for liquid fire extinguishing agent of the present invention, FIG. 5(*a*) is a front sectional view and, FIG. 5(*b*) is a bottom view.
Figure 5B:
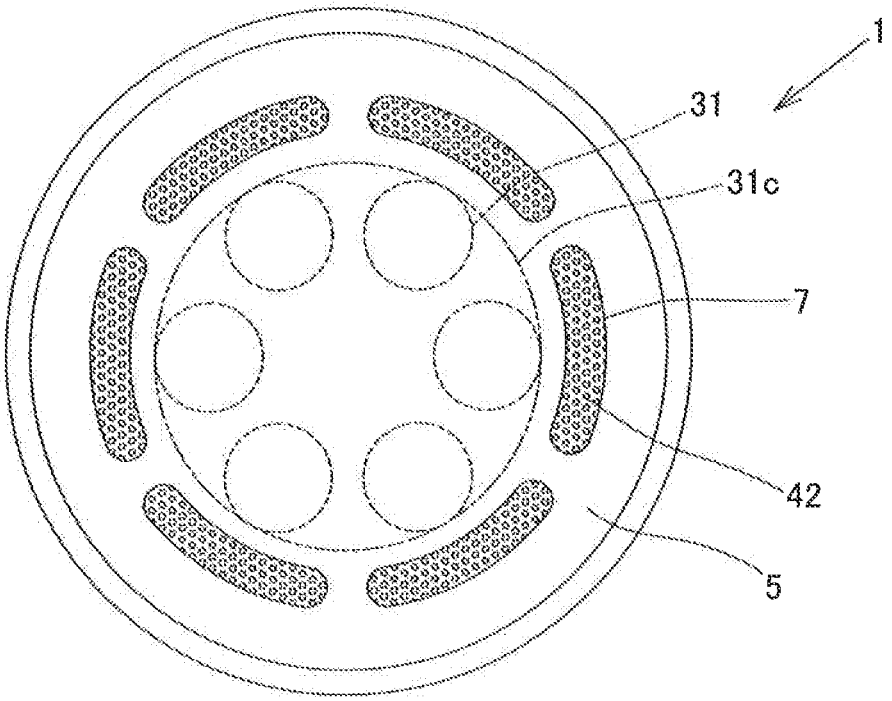
Figure 6A:
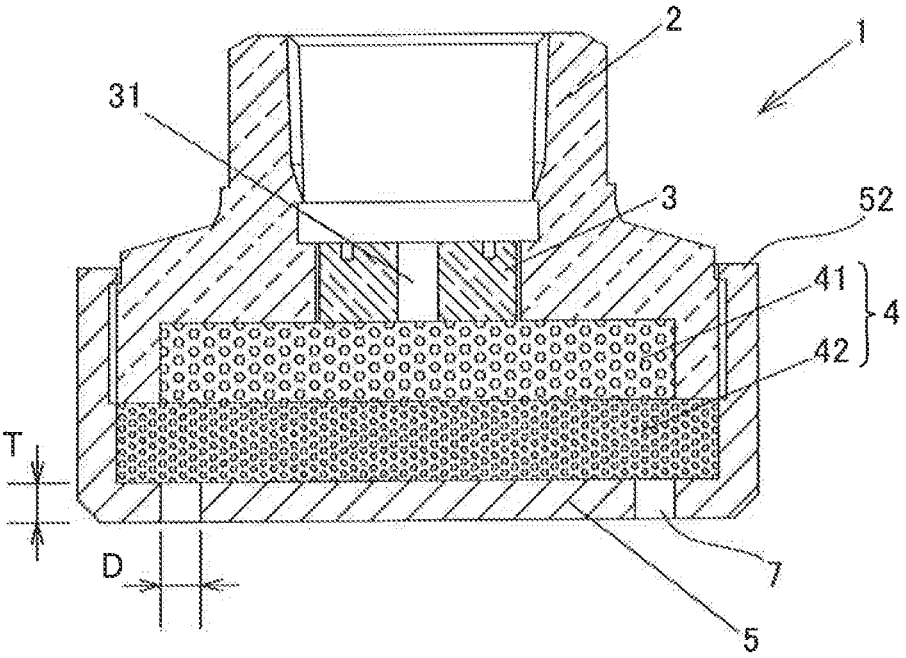
FIGS. 6(*a*) and 6(*b*) are drawings illustrating a modified embodiment of the first embodiment of the injection head for liquid fire extinguishing agent of the present invention, FIG. 6(*a*) is a front sectional view and, FIG. 6(*b*) is a bottom view.
Figure 6B:
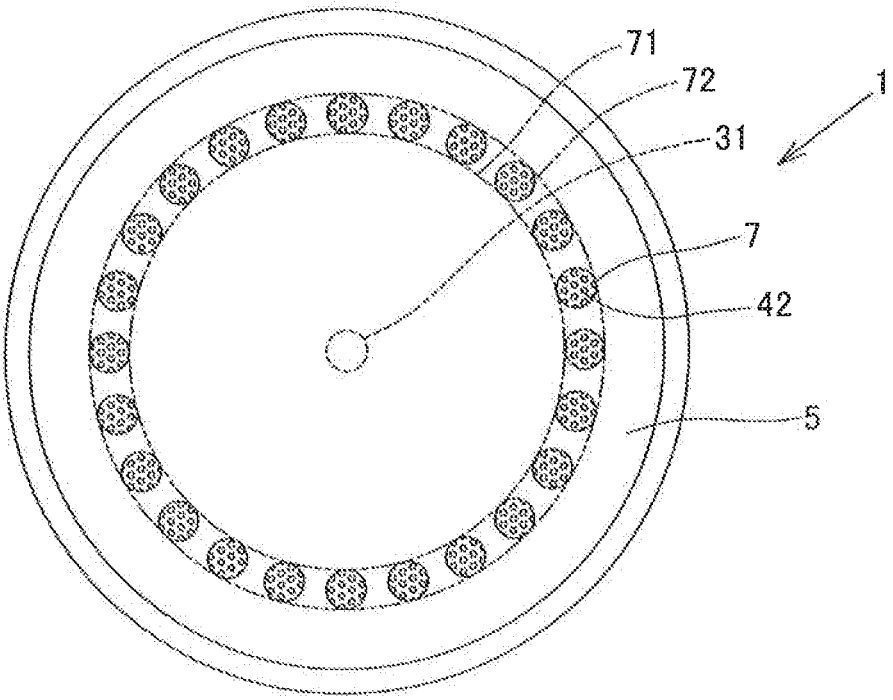

Also, in the first embodiment abovementioned, the baffle plate 5 is fastened to the injection head body 2 by screwing the thread part 51 penetrating the central part of the porous member 4 to the orifice plate 3, but like modified embodiments shown in FIG. 5 and FIG. 6, the baffle plate 5 has a cap structure having a rising part 52 and, can be fastened by screwing to the injection head body 2.

Then, in modified embodiments shown in FIG. 5 and FIG. 6, by contacting the baffle plate 5 with the end surface of another side of the porous member 4, and the baffle plate 5 covers at least a projected area of the circumscribed circle 31*c* of the orifice 31 of an end surface of the porous member 4 (In the present embodiment, 6 pieces of the common circumscribed circles 31*c* of the orifice 31), and hence making the liquid fire extinguishing agent not release from this part and, as well as the liquid fire extinguishing agent is released via the through hole 7 formed outside of the projected area of the circumscribed circle 31*c* of the orifice 31 of the baffle plate 5 (In the present embodiment, 6 pieces of the common circumscribed circles 31*c* of the orifice 31).

The through hole 7 is comprising of oblong holes (a modified embodiment shown in FIG. 5) or round holes (a modified embodiment shown in FIG. 6) that are arranged in torus shape, and hence release form of the liquid fire extinguishing agent can be a cylindrical shape in the same direction as the axial direction of the orifice 31 (The axial direction of the central axis of the injection head body 2).

Here, the width dimension D and a formation interval of the through hole 7 can be properly set according to the capacity of the injection head for liquid fire extinguishing agent 1 or the liquid fire extinguishing agent which is the subject, but the dimension D of the through hole 7 is set preferably 30 mm or less, more preferably 1 mm to about 10 mm and, it is set as being the ratio of a diameter of the small-diameter circle 71 to a diameter of the large-diameter circle 72 contacting commonly with a plurality of through holes 7 0.70 or more.

Also, the dimension T in the thickness direction of the through hole 7 (The baffle plate 5) can be set preferably 30 mm or less, more preferably 1 mm to about 10 mm, so as to be able limiting the releasing direction of the liquid fire extinguishing agent in a specific direction.

As a result, the diffusion characteristic in the same direction as the axial direction (An axial direction of the central axis of the injection head body 2) of the orifice 31 of the liquid fire extinguishing agent can be improved.

By the way, in each embodiment abovementioned, the release form of the liquid fire extinguishing agent is the cylindrical shape in the same direction as the axial direction of the orifice 31 (The axial direction of the center direction of the injection head body 2), but for example, like the second embodiment of the injection head for liquid fire extinguishing agent of the present invention shown in FIG. 7, not limited, notches 22, 53 are formed by cutting conically the injection head body 2 and the baffle plate 5 that are located in the gap 6, and hence a release form of the liquid fire extinguishing agent has conical shape having predetermined angle to the axial direction of the orifice 31 (In the present embodiment, it sets about 65°, but this angle can be set arbitrary angle of 0 to 90°).

Here, the width dimension of the gap 6 comprising slits having torus shapes can be properly set according to the capacity of the injection head for liquid fire extinguishing agent 1 or the liquid fire extinguishing agent which is the subject, but it is set preferably 30 mm or less, more preferably 1 mm to about 10 mm.

As a result, the diffusion characteristics in the same direction as the axial direction of the orifice 31 of the liquid fire extinguishing agent can be improved, and further, by providing a diffusion characteristics in the directional component orthogonal to the axial direction of the orifice 31 of the liquid fire extinguishing agent, the liquid fire extinguishing agent can be sprayed and vaporized in more wide scope.

Moreover, as the release form of the liquid fire extinguishing agent, like the third embodiment of the injection head for liquid fire extinguishing agent of the present invention shown in FIG. 8, by arranging the gap 6 in a lower end side of the injection head body 2, the release form of the liquid fire extinguishing agent can be having a disk shape in the direction orthogonal to the axial direction of the orifice 31.

Here, the width dimension of the gap 6 comprising slits having torus shapes can be properly set according to the capacity of the injection head for liquid fire extinguishing agent 1 or the liquid fire extinguishing agent which is the subject, but it is set preferably 30 mm or less, more preferably 1 mm to about 10 mm.

Also, a dimension T in the thickness direction of the gap 6 comprising of slits having torus shapes can be arranged preferably 30 mm or less, more preferably 1 mm to about 10 mm, so as to be able limiting the releasing direction of the liquid fire extinguishing agent in a specific direction.

As a result, the diffusion characteristic in the direction orthogonal to the axial direction of the orifice 31 of the liquid fire extinguishing agent, the liquid fire extinguishing agent can be sprayed and vaporized in more wide scope.

By the way, in the present embodiment, the orifice plate 3 and the porous member 4 have one-step structure, but like a modified embodiment shown in FIG. 9, they can be 2 step structure (or a multistage structure comprising 3 or more steps) by arranging an orifice plate 3A, formed with an orifice 31A, and a porous member 4A in the upstream sides of the orifice plate 3 and the porous member 4.

As a result, inside the injection head body 2, uniform diffusion characteristics of the liquid fire extinguishing agent can be improved.

Also, the baffle plate 5 is screwed to the orifice plate 3 by the thread part 51 penetrating the center part of the the porous member 4, but instead of this, the injection head body 2 and the baffle plate 5 can be fastened by using thread member 8.

Figure 10A:
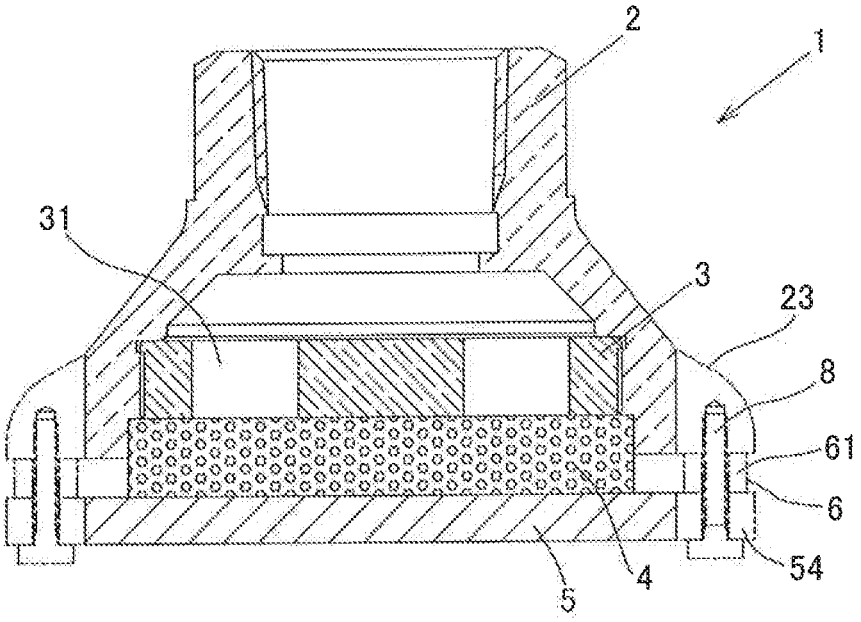
FIGS. 10(*a*) and 10(*b*) are drawings illustrating a modified embodiment of the third embodiment of the injection head for liquid fire extinguishing agent of the present invention, FIG. 10(*a*) is a front sectional view and, FIG. 10(*b*) is a bottom view.
Figure 10B:
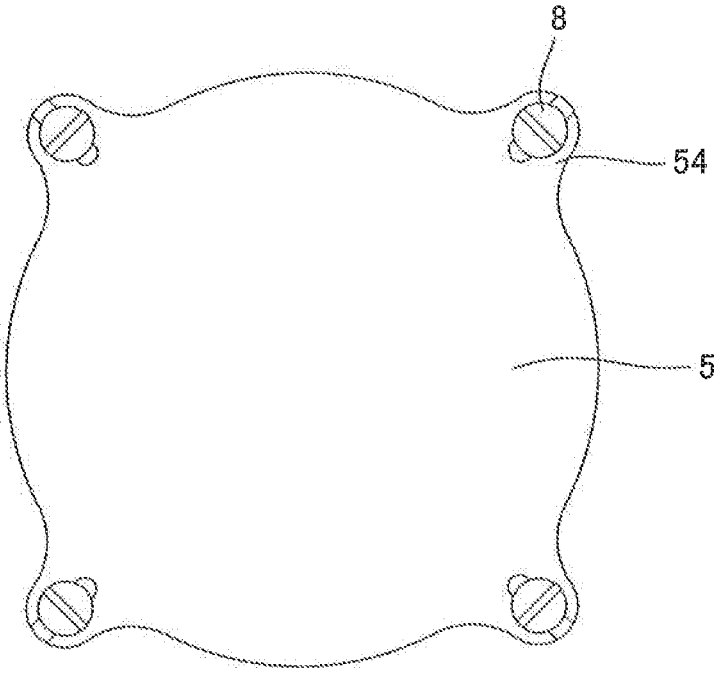

Specifically, like a modified embodiment shown in FIG. 10, bulging parts 23, 54 protruding partially are formed in outer peripheral sides of the injection head body 2 and the baffle plate 5, the injection head body 2 and the baffle plate 5 can be fastened by using the thread member 8 on the location of these bulging parts 23, 54.

Here, on the location of the thread member 8, it can be interposed a spacer 81 according to the need.

Also, like a modified embodiment shown in FIG. 11, it can be fastened the injection head body 2 and the baffle plate 5 by using the thread member 8 penetrating through the porous member 4.

Here, when connecting the injection head body 2 to a pipe (not shown) providing the liquid fire extinguishing agent, an operation hole 24 is formed in the outer peripheral surface of the injection head body 2 for mounting a fastening tool (not shown).

Figures 1A, 12:
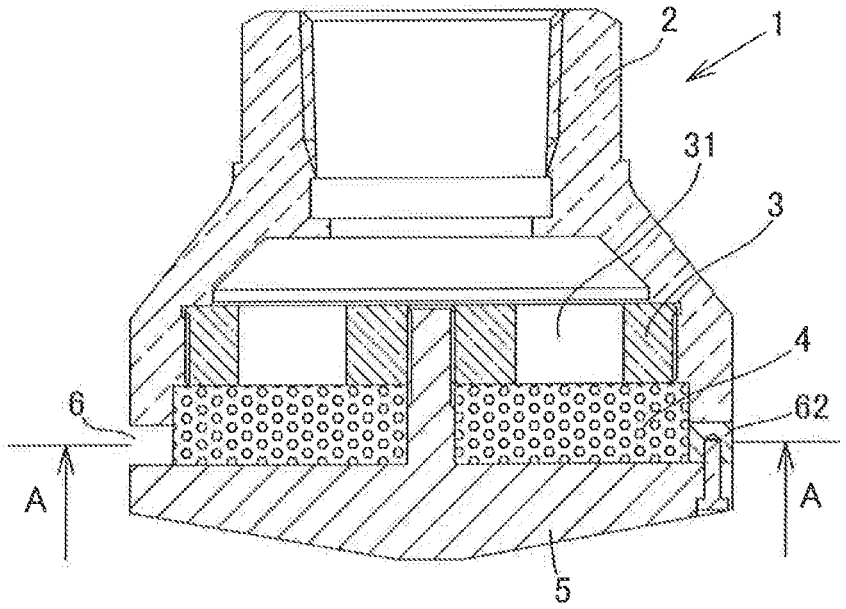
Figures 1B, 12:
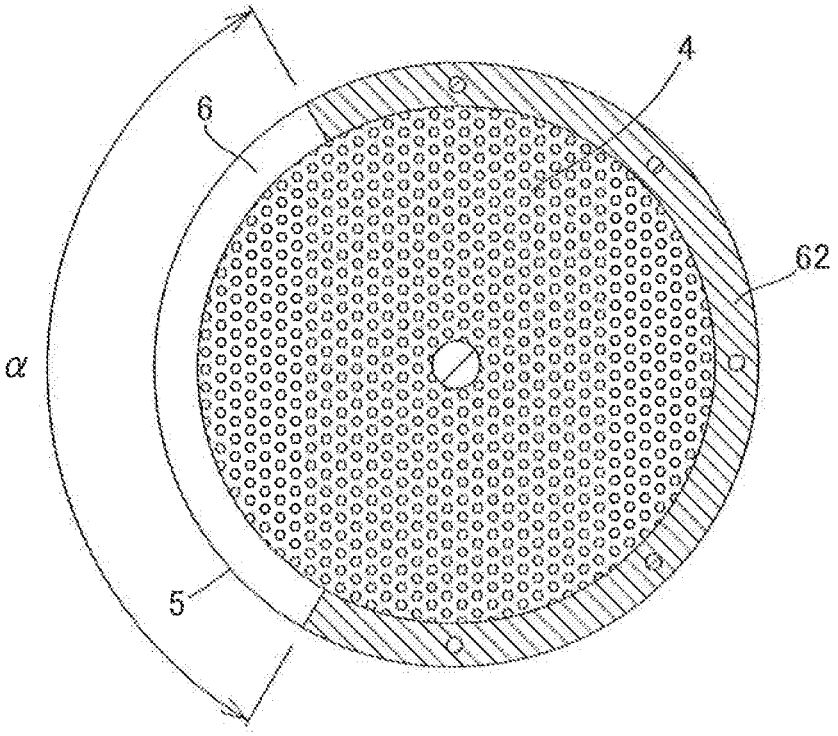
Figures 2A, 12:
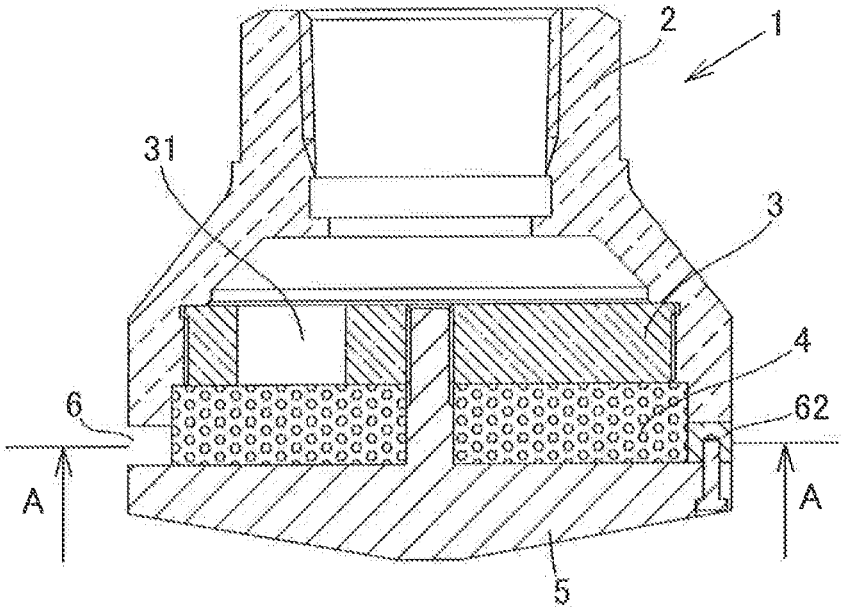
Figures 2B, 12:
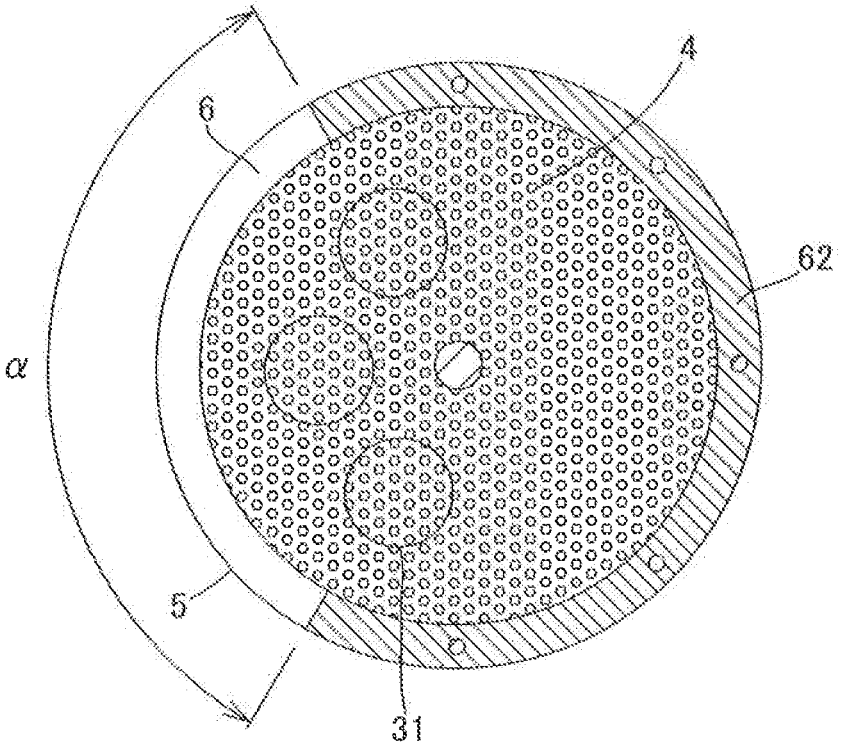

By the way, as a release form of the liquid fire extinguishing agent, like a modified embodiment shown in FIG. 12, the release form of the liquid fire extinguishing agent has a fan shape having a predetermined angle a in the direction orthogonal to the axial direction of the orifice 31.

This release form of the liquid fire extinguishing agent can be easy obtained by closing a part of the gap 6 by a closing member 62 in which the gap 6 is formed between the injection head body 2 and the baffle plate 5 and comprising slits having a torus shape releasing the liquid fire extinguishing agent.

The angle a can be set at an arbitrary angle (For example, in a scope of 30° to 330°) according to such as an arranging form of the injection head 1.

As a result, the diffusion characteristic in the direction orthogonal to the axial direction of the orifice 31 of the liquid fire extinguishing agent, the liquid fire extinguishing agent can be sprayed in a specific direction and vaporized, and hence for example, it can be preferably used for the injection head 1 arranged in an internal corner part of a room constituting a fire extinguishing area.

In this case, like a modified embodiment shown in FIG. 12-2, the orifice 31 that arranged in equiangular spacing (In the modified embodiment shown in FIG. 12-1, 6 pieces in 60° spacing) can be arranged in nonuniform distribution.

As a result, releasing characteristics of the liquid fire extinguishing agent can be easily changed and adjusted in various ways.

Figures 2A, 13:
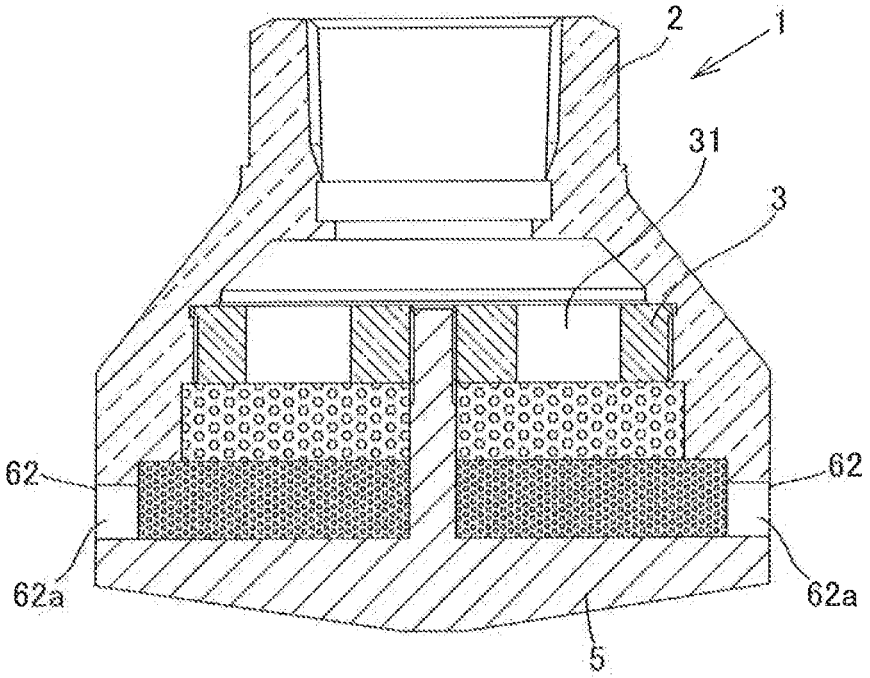
Figures 2B, 13:
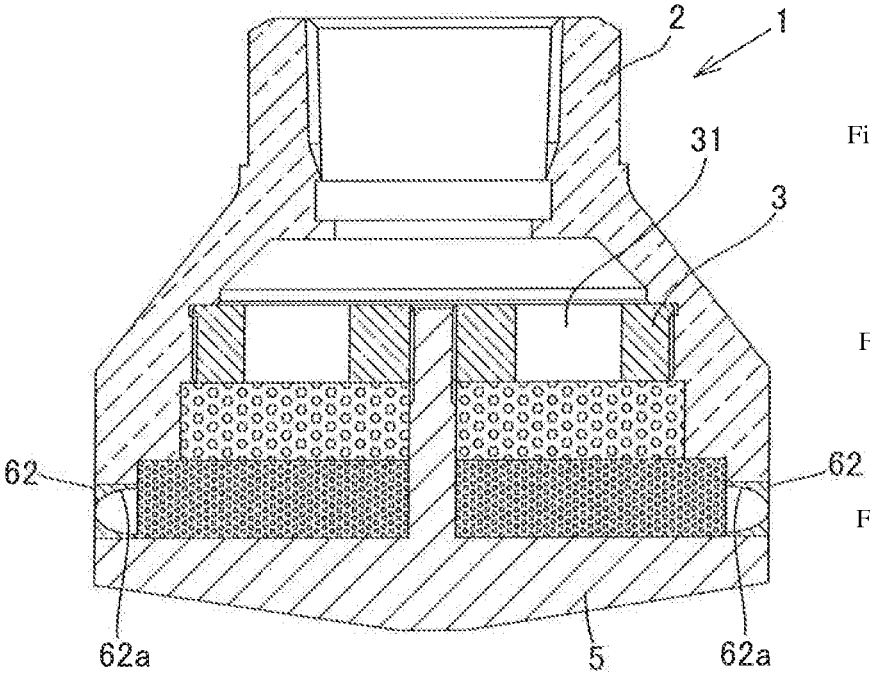
Figures 2C, 13:
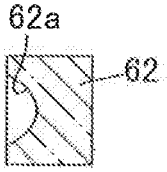
Figures 2D, 13:
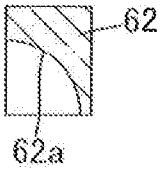
Figures 2E, 13:
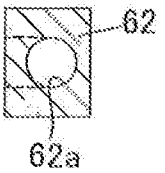

Further, like modified embodiments shown in FIG. 13-1 and FIG. 13-2, a partition wall (An end surface 62*a* of a closing member 62) for making a release form of the liquid fire extinguishing agent a fan shape and that forms both ends of the gap 6 formed between the injection head body 2 and the baffle plate 5 is arranged on an inclined surface facing to the opposite side (Deep side) of the gap 6 and, the gap 6 having a wedge shape is formed between this inclined surface (The end surface 62*a* of the closing member 62) and the outer peripheral surface of the porous member 4.

In this case, the inclined surface (The end surface 62*a* of the closing member 62) is formed preferably in a shape circumscribing an outer peripheral surface of the porous member 4.

As a result, a flow of the liquid fire extinguishing agent (Vaporization state) along the inclined surface (The end surface 62*a* of the closing member 62) from the gap 6*a* having a wedge shape is generated, then by changing the flow direction along the radial direction of the liquid fire extinguishing agent (Vaporization state), an open area to the atmosphere of the porous member 4 can be expanded (For angle β limiting the release angle of the liquid fire extinguishing agent, the level of the open area to the atmosphere of the porous member 4 can be based of the angle a larger than the angle β), and the diffusion characteristics in the direction orthogonal to the axial direction of the orifice of the liquid fire extinguishing agent can be further improved.

In this case, a shape of the inclined surface (The end surface 62*a* of the closing member 62) is no limited to plane shapes of the modified embodiments shown in FIG. 13-1 and FIG. 13-2, and can be curved shapes, like modified embodiments shown in FIG. 13-2(*b*) to (*e*).

Here, the end surface 62*a* of the closing member 62 is processed so as to that in FIG. 13-2(*b*) illustrated a semicircular opening as open, in FIG. 13-2(*c*) illustrated a semicircular opening smaller than the beforementioned semicircular opening as open, in FIG. 13-2(*d*) illustrated a ¼ circular opening as open, in FIG. 13-2(*e*) a circular opening as open.

Here, the end surface 62*a* of the closing member 62 is processed so as that a semicircular opening illustrated in FIG. 13-2(*b*) as open, a semicircular opening smaller than the beforementioned semicircular opening illustrated in FIG. 13-2(*c*) as open, a ¼ circular opening illustrated in FIG. 13-2(*d*) as open and, a circular opening illustrated in FIG. 13-2(*e*) as open.

As a result, by changing the shape of the inclined surface (The end surface 62*a* of the closing member 62), the shape or the dimension of the openings can be changed, and hence without large changing the body shape, releasing characteristics of the liquid fire extinguishing agent can be changed and adjusted in various ways.

Also, instead of the gap 6 comprising of slits having torus shape for releasing the liquid fire extinguishing agent, the liquid fire extinguishing agent can be released via the through hole 7 formed outside of the projected area of the circumscribed circle of the orifice 31 (In the present embodiment, 6 pieces of the common circumscriber circles of orifice 31).

The through hole 7 has oblong holes, like a modified embodiment shown in FIG. 14, arranged in torus shape on the rising part 52 of the baffle plate 5 that is a cap structure having the rising part 52; long holes, like a modified embodiment shown in FIG. 15, arranged a plurality of steps in torus shape in the rising part 52 of the baffle plate 5 that is a cap structure having a rising part 52 (In the embodiment shown, 2 steps. Like this multistep, while keeping a preferable gap width, the open area to the atmosphere can be expanded), round holes, like a modified embodiment shown in FIG. 16, arranged in torus shape formed in a lower part of the injection head body 2 (A part arranged in the downward and facing the outer peripheral surface of the porous member 42).

Here, the width dimension D and the formation interval of the through hole 7 can be properly set according to the capacity of the injection head for liquid fire extinguishing agent 1 or the liquid fire extinguishing agent which is the subject, but the dimension D of the through hole 7 is set preferably 30 mm or less, more preferably 1 mm to about 10 mm.

Also, the dimension T in the thickness direction of the through hole 7 (The rising part 52 of the baffle plate 5 or the injection head body 2) can be set preferably 30 mm or less, more preferably 1 mm to about 10 mm, so as to be able limiting the releasing direction of the liquid fire extinguishing agent in a specific direction.

As a result, the diffusion characteristic in the direction orthogonal to the axial direction of the orifice 31 of the liquid fire extinguishing agent, the liquid fire extinguishing agent can be sprayed and vaporized in more wide scope.

By the way, in each above mentioned embodiment, a direction to release the liquid fire extinguishing agent is set in one direction, but by combination of each above mentioned embodiment, it can be made two direction to release the liquid fire extinguishing agent.

Figure 17A:
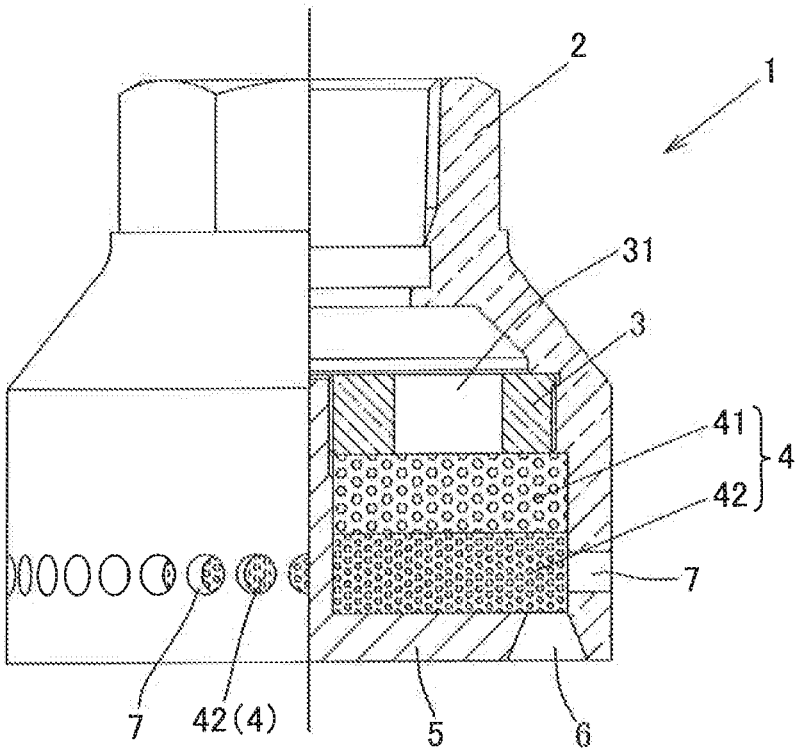
FIGS. 17(*a*) and 17(*b*) are drawings illustrating a forth embodiment of an injection head for liquid fire extinguishing agent of the present invention, FIG. 17(*a*) is a front sectional view and, FIG. 17(*b*) is a bottom view.
Figure 17B:
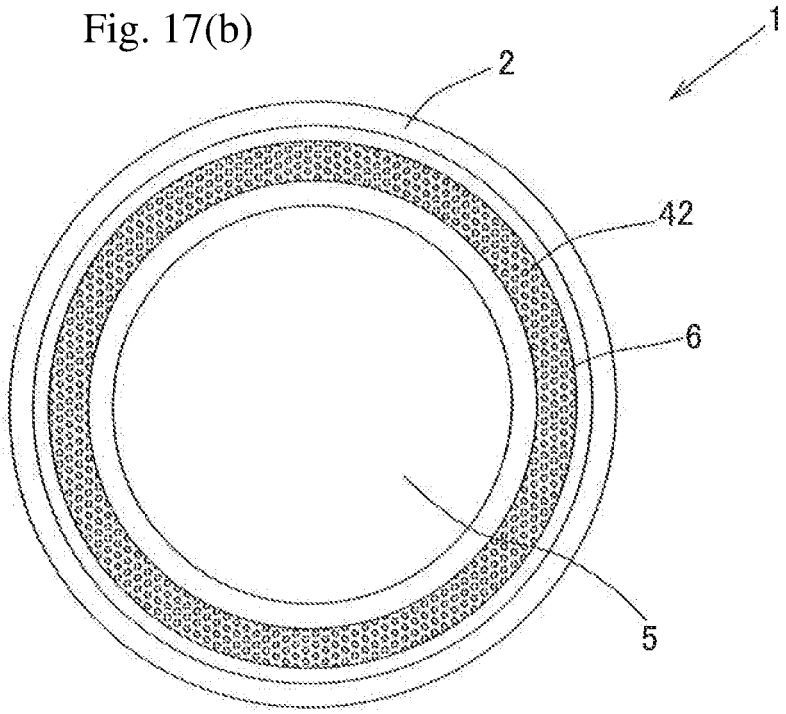

For example, like the forth embodiment of the injection head for liquid fire extinguishing agent of the present invention shown in FIG. 17, by combining the first embodiment shown in FIG. 1 and the third embodiment shown in FIG. 16, the liquid fire extinguishing agent is released in cylindrical shape in the same direction as the axial direction of the orifice 31 (The axial direction of the central axis of the injection head body 2) from the gap 6 formed between the injection head body 2 and the baffle plate 5, and as well as is released in disk shape in the direction orthogonal to the axial direction of the orifice 31 from the through hole 7 composing of around holes arranged in torus shape arranged in the lower part of the injection head body 2 (A part arranged in the downward and facing the outer peripheral surface of the porous member 42).

As a result, the diffusion characteristics in the direction as the same direction or orthogonal to the axial direction of the orifice 31 of the liquid fire extinguishing agent is improved and, the liquid fire extinguishing agent can be sprayed and vaporized in more wide scope.

As described above, the injection head for liquid fire extinguishing agent of the present invention is described by referring a plurality of embodiments, but it must be noted that the present invention is not limited to configurations of the above mentioned embodiments; but may be changed or modified in various forms within the true spirit thereof such as configurations described in each embodiment can be combined appropriately.

INDUSTRIAL APPLICABILITY

The injection head for liquid fire extinguishing agent of the present invention has good diffusion characteristics and vaporization characteristics of liquid fire extinguishing agent, can be enlarge the fire extinguishing scope covering by one injection head and, can enhance reduction efficiency of noise; and hence in the fire extinguishing equipment using liquid fire extinguishing agent, it can be used in wide in the injection head set for releasing liquid fire extinguishing agent into a fire extinguishing area, the object for application is not limited fire extinguishing equipments newly set, but it can be applied to existing fire extinguishing equipments by exchanging only injection heads.

DESCRIPTION OF THE REFERENCE NUMERALS

1 . . . Injection head
2 . . . Injection head main body
21 . . . step part
22 . . . Notch
23 . . . Bulging part
24 . . . Operation hole
3 . . . Orifice plate
31 . . . Orifice
4 . . . Porous member
41 . . . Porous member
42 . . . Porous member
5 . . . Baffle plate
51 . . . Thread part
52 . . . Rising part
53 . . . Notch
54 . . . Bulging part
6 . . . Gap
7 . . . Through hole
8 . . . Thread member
81 . . . Spacer

The invention claimed is:

1. An injection head for liquid fire extinguishing agent, in a fire extinguishing equipment using a liquid fire extinguishing agent, the injection head arranged for releasing the liquid fire extinguishing agent to a fire extinguishing area, wherein the injection head comprising of: an injection head body for connecting with a pipe providing the liquid fire extinguishing agent; an orifice plate arranged in the injection head body and forming with an orifice through which flowing the liquid fire extinguishing agent; a porous member having a block shape arranged in a exiting part of the orifice; and a baffle plate contacting with a end surface of said porous member opposite side of the exiting part of the orifice; wherein said baffle plate covers at least a projected area of a circumscribed circle of the orifice of an end surface of the porous member and, as well as the liquid fire extinguishing agent is released via a gap formed between the injection head body and the baffle plate, and/or, a through hole formed outside of the projected area of the circumscribed circle of the orifice of the injection head body and/or the baffle plate.

2. The injection head for liquid fire extinguishing agent according to claim 1, wherein a release form of said liquid fire extinguishing agent has a cylindrical shape in a direction as the same as an axial direction of the orifice.

3. The injection head for liquid fire extinguishing agent according to claim 1, wherein a release form of said liquid fire extinguishing agent has a conical shape having a predetermined angle to an axial direction of an orifice.

4. The injection head for liquid fire extinguishing agent according to claim 1, wherein a release form of said liquid fire extinguishing agent has a disk shape in a direction orthogonal to an axial direction of the orifice.

5. The injection head for liquid fire extinguishing agent according to claim 1, wherein a release from of said liquid fire extinguishing agent has a fan shape having a predetermined angle in a direction orthogonal to an axial direction of the orifice.

6. The injection head for liquid fire extinguishing agent according to claim 5, wherein a partition wall for making a release form of said liquid fire extinguishing agent a fan shape and that forms both ends of the gap formed between the injection head body and the baffle plate is arranged on an inclined surface facing to the opposite side of the gap and, the gap having a wedge shape is formed between the inclined surface and the porous member.

7. The injection head for liquid fire extinguishing agent according to claim 1, wherein said gap and/or a width dimension of the through hole is 30 mm or less.

8. The injection head for liquid fire extinguishing agent according to claim 7, wherein the width dimension of said gap and/or the through hole is 1 mm to 10 mm.

9. The injection head for liquid fire extinguishing agent according to claim 1, wherein the ratio of an inner diameter to an outer diameter of said gap, and/or the ratio of a diameter of a small-diameter circle to a diameter of a large-diameter circle that are contacting commonly with a plurality of the through holes are 0.7 or more.

* * * * *